US005244086A

United States Patent [19]

Welch

[11] Patent Number: 5,244,086

[45] Date of Patent: Sep. 14, 1993

[54] ENCLOSED GOLF BAG WITH ROTARY CAP

[76] Inventor: Gordon D. Welch, 129 English Village Rd., Manchester, N.H. 03102

[21] Appl. No.: 808,427

[22] Filed: Dec. 16, 1991

Related U.S. Application Data

[63] Continuation-in-part of Ser. No. 737,341, Jul. 29, 1991, abandoned.

[51] Int. Cl.[5] ..... A63B 55/00

[52] U.S. Cl. ..... 206/315.4; 150/159

[58] Field of Search ..... 206/315.2-315.8; 150/159, 160

[56] References Cited

U.S. PATENT DOCUMENTS

| | | | |
|---|---|---|---|
| 1,227,657 | 5/1917 | Pierce | 206/315.6 |
| 1,493,828 | 5/1924 | Stocks | 206/315.4 |
| 2,256,512 | 9/1941 | Kirkpatrick et al. | 206/315.3 |
| 2,806,711 | 9/1957 | Jacobs | 206/315.6 X |
| 2,879,819 | 3/1959 | Turnbull | 206/315.4 |
| 2,890,061 | 6/1959 | Watson | 206/315.6 X |
| 3,425,708 | 2/1969 | Sato | 206/315.6 X |
| 3,620,276 | 11/1971 | Taylor | 150/159 |
| 3,707,279 | 12/1972 | Kaiser | 206/315.4 X |
| 3,754,587 | 8/1973 | Rainiert | 150/159 |
| 4,111,248 | 9/1978 | Leichhardt | 206/315.6 |
| 4,234,025 | 11/1980 | Berge | 150/160 X |
| 4,245,684 | 1/1981 | Street et al. | 206/315.6 X |
| 4,383,563 | 5/1983 | Kirchhoff, Jr. | 206/315.2 |
| 4,512,465 | 4/1985 | Sobe | 206/315.4 |
| 4,673,082 | 6/1987 | Hemme | 206/315.6 |
| 4,709,814 | 12/1987 | Antonius | 206/315.3 |
| 4,750,617 | 6/1988 | Anderson et al. | 206/315.6 |
| 4,753,344 | 6/1988 | Antonious | 206/315.6 X |
| 4,852,896 | 8/1989 | Mills | 206/315.6 X |
| 4,915,221 | 4/1990 | Spangler | 206/315.6 |

FOREIGN PATENT DOCUMENTS

| | | | |
|---|---|---|---|
| 476107 | 11/1937 | United Kingdom | 206/315.3 |
| 2130102 | 5/1984 | United Kingdom | 206/315.3 |

*Primary Examiner*—Sue A. Weaver

*Attorney, Agent, or Firm*—Hayes, Soloway, Hennessey & Hage

[57] ABSTRACT

An enclosed golf bag with a protective cap that rotates relative to a fixed outer bag surface and stationary golf clubs contained therein is provided. An opening in the cap permits access to one or more clubs.

11 Claims, 5 Drawing Sheets

ENCLOSED GOLF BAG WITH ROTARY CAP

The present application is a continuation-in-part of co-pending application Ser. No. 07/737,341 filed Jul. 29, 1991, now abandoned.

FIELD OF THE INVENTION

The present invention relates generally to golf bags and, more particularly, to improvements in enclosed golf bags utilized for protecting golf clubs contained within from damage due to environmental elements, travel and unauthorized access. The present invention will be described in connection with such specific utility, although other utility is contemplated.

BACKGROUND OF THE INVENTION

Golf clubs can be damaged from various environmental elements and from various modes of carrying including but not limited to those modes utilized while on the golf course and while traveling with the golf clubs. It is desirable to provide means for protecting the golf clubs carried on the golf course as well as the golf clubs designated for travel, especially on an airline. Various means have been contemplated to provide protection to golf clubs from such environmental elements as a constant drizzle experienced on the golf course in the spring, a sudden shower experienced on the golf course in the summer or even a sudden hail storm. Various other means have been contemplated to protect the golf clubs against damage due to rough or abusive handling during travel, particularly in the baggage section of the airline. Of particular desirability is the protection from damage due to iron-headed clubs chipping or scarring wood-headed clubs during travel due to general storage proximity of all clubs, or displacement due to unauthorized access to any club in the bag.

As a result, various carrying and protection means have been developed and are available commercially for protecting golf clubs while carrying them or while traveling with them. For protecting golf clubs from environmental elements experienced while on the golf course, various types of covers or hoods have been developed. For example, U.S. Pat. No. 4,234,025 to Berge, U.S. Pat. No. 3,754,587 to Rainieri, and U.S. Pat. No. 3,620,276 to Taylor, and U.S. Pat. No. 1,493,828 to Stocks teach flexible covers which are placed over the exposed heads of golf clubs in a conventional golf bag in order to protect the golf club heads from environmental elements when necessary, and are removable from the golf bag when not necessary. When not needed to cover exposed golf club heads, these covers can be attached to the side of the golf bag or stored within the golf bag due to their flexible nature, but cannot provide adequate protection against damage to the golf clubs if used in a traveling situation. In addition, Great Britain Patent No. 476,107 to Lawton, et al teaches a similar hood but with separate compartments and separate accessibility. These separate compartments store and protect wooden-headed clubs separately from iron-headed clubs. As taught by Lawton, a hood may be permanently attached to a golf bag, but the separate compartments in the hood for each type of golf club head require separate accessibility to each separate compartment when desiring a wood-headed golf club as opposed to an iron-headed golf club.

Further, U.S. Pat. No. 4,750,617 to Anderson et al, U.S. Pat. No. 3,425,708 to Sato, U.S. Pat. No. 2,890,061 to Watson, U.S. Pat. No. 2,806,711 to Jacobs, U.S. Pat. No. 4,245,684 to Street et al, U.S. Pat. No. 4,111,248 to Leichardt, U.S. Pat. No. 4,673,082 to Hemme, U.S. Pat. No. 4,915,221 to Spangler, U.S. Pat. No. 4,753,344 to Antonious, and U.S. Pat. No. 4,852,896 to Mills each teach means for carrying golf clubs wherein the clubs contained therein are selected or accessed by rotating the clubs relative to a fixed external bag surface. Moreover, the carrying means taught by Sato, Watson and Jacobs each teach the golf club handles protruding from the top or exposed open end of said carrying means. Additionally, Jacobs teaches a golf cart comprising a wheel-mounted frame.

Other related art includes an enclosed golf bag with a removable cover as taught by U.S. Pat. No. 4,383,563 to Kirschoff, Jr., which provides a golf bag with a removable cover wherein the golf clubs contained therein rotate along with the exterior surface of the golf bag relative to a fixed base on which the exterior surface rests. Further, Patent No. FR 2646-785-A to Meniel teaches a non-enclosed golf bag with a locking mechanism.

Noted disadvantages with the prior art include the fact that golf clubs carried within the golf bag are selected by rotating the golf clubs within the golf bag. To achieve this club rotation, a wide variety of items, such as clips, ball bearings, rollers, cups, guides and pins are needed. The rotating mechanisms are complex and difficult to economically manufacture and to maintain.

Another disadvantage with the prior art includes the fact that the flexible and removable cover does not provide adequate protection to golf club heads which are stored on the same level with each other and in close proximity to each other so as to scar, chip or otherwise damage the surface of the golf club heads due to one golf club head coming into contact with a second golf club head during the bumping and handling experienced while being transported in the golf club bag. In particular, these covers often do not eliminate the need for a separate travel bag required for airline travel.

A further disadvantage with the prior art is the requirement of a separate locking device to prevent unauthorized access to the clubs in the golf bag.

Another disadvantage with the prior art is the limited access to the golf clubs provided by the prior art related to enclosed golf bags. In particular, Street teaches a door on the top of a rotary cap which opens in an upward direction. This door, when aligned with a club head within the bag body allows for the removal of a sole club. Additionally, this club must be removed from the top of the bag in a strictly upward or vertical motion. This method of club extraction is awkward and clumsy for the average golfer.

SUMMARY OF THE INVENTION

The present invention provides for a totally enclosed golf bag which protects normally exposed golf club heads by enclosing the open end of the golf bag with a rotary cap which rotates around the top body of the attached golf bag. Access to the enclosed golf clubs is provided through an opening in the rotary cap which is covered by a flap which can zippered or secured in an opened or closed position.

More particularly, the present invention provides an enclosed golf bag comprising an outer bag body and an inner bag body with a two level top surface. A track is mounted adjacent the top of the outer bag body for receiving and capturing wheels carried on the cap such that the wheels are free to rotate within the track but not free to be readily removed from the track. A rotary cap equipped with an access opening and flap covering, and having a plurality of wheels mounted and spaced evenly adjacent the lower perimeter of the rotary cap. The wheels are mounted such that once positioned, the wheels rotate freely and when positioned within the track, affix the rotary cap to the golf bag without inhibiting the rotation of the rotary cap on the axles of the wheels about the axis located longitudinally through the center of the golf bag. Completing the golf bag in accordance with the present invention is a connecting rod running from the bottom center of the golf bag and the top center of the rotary cap.

BRIEF DESCRIPTION OF THE DRAWINGS

In order to more fully understand the invention, reference should be made to the following detailed description taken in connection with the accompanying drawings wherein like numerals depict like parts, and wherein.

DETAILED DESCRIPTION OF THE PREFERRED EMBODIMENTS

The present invention provides for a golf bag which protects golf club heads by enclosing the open end of a conventional golf bag with a rotatably mounted cap which rotates around the top end of the golf bag. Access to the enclosed golf clubs is provided through an opening in the rotary cap which is covered by a flap that can be zippered or secured in an open or closed position.

Figure 1:
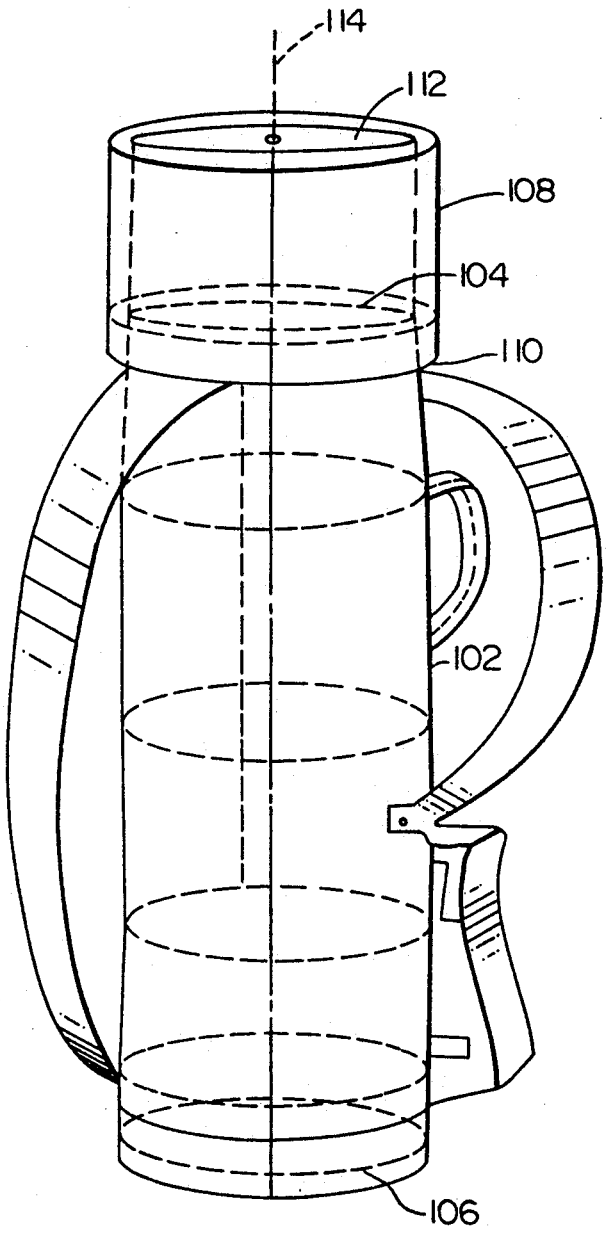
FIG. 1 is a side view of the present invention with the rotary cap attached to the outer bag body.

A specific embodiment of the outside of the present invention is shown in FIG. 1. A golf bag body 102 has a first open end 104 of generally circular shape and a second closed end 106. A cap 108 has a first open end 110 of generally circular shape and a second closed end 112. The cap 108, which preferably is formed of a rigid plastic or the like, is rotatably attached to the golf bag body 102 at the first end 104 and the open end 110 to permit the cap 108 to rotate about an axis defined by imaginary axis 114.

Figure 2:
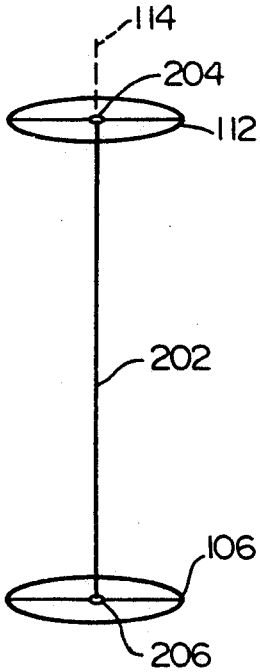
FIG. 2 is a side view of the top to bottom connecting rod.

Referring to FIG. 2 a connecting rod 202 runs between center point 204 of the closed end 112 and a center point 206 of the second end 106 and prevents removal of rotary cap 108 from the golf bag body 102. One or both ends of rod 202 are mounted free to rotate, for example in a bearing (not shown), or the like.

Figure 3:
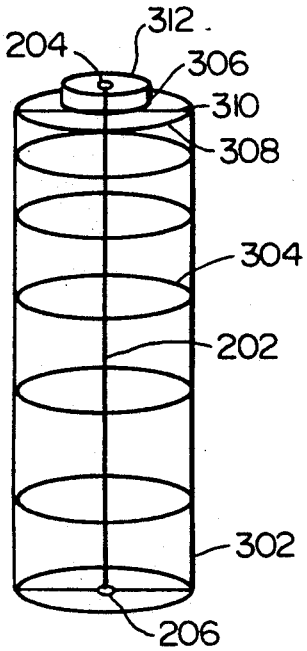
FIG. 3 is an isometric view of the inner bag body with circular rib supports as well as the connecting rod located through the center of each supporting rib.

Referring now to FIG. 3, carried inside the golf bag body 102 is a plastic sleeve 302, which is supported by a plurality of circular plastic ribs 304 evenly interspersed longitudinally along the plastic sleeve 302 to provide support. FIG. 3 is shown without the rotary cap 108 attached, thereby providing a view of a two-level surface 306 with an outer edge 308 as defined by the first end 104. The two-level surface has a first level 310 and a second level 312 which enables club heads stored in the second level 312 to be stored in a position higher than the club heads of the clubs stored in the first level 310.

Figure 4:
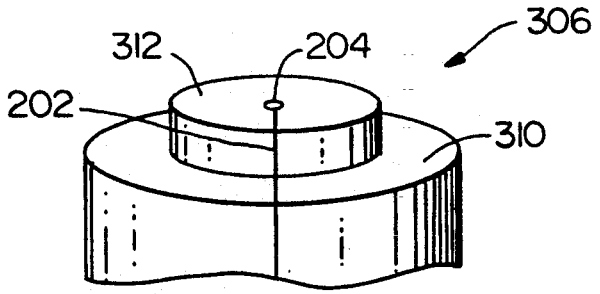
FIG. 4 is an isometric view of the inner bag top surface.

Referring also to FIG. 4 which is a close-up view of the two level surface 306 and better illustrates the feature of storing the wood-headed clubs in the second level 312 in order to position these club heads higher than the club heads of the irons stored in the lower first level 310, so as to provide greater protection against scarring and chipping of the wood-headed club faces, which are the most frequently damaged clubs.

Figure 5:
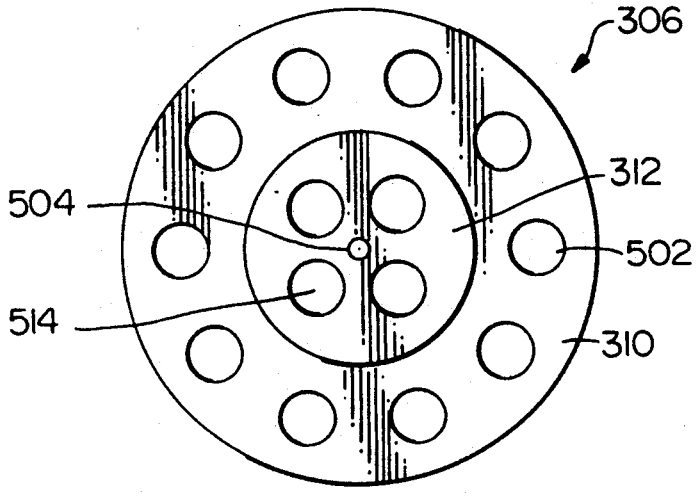
FIG. 5 is a top plan view of the inner bag top surface showing club openings.
Figure 6:
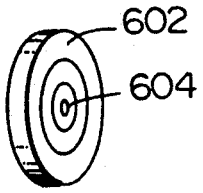
FIG. 6 is a perspective view of a wheel useful in the present invention.
Figure 7:
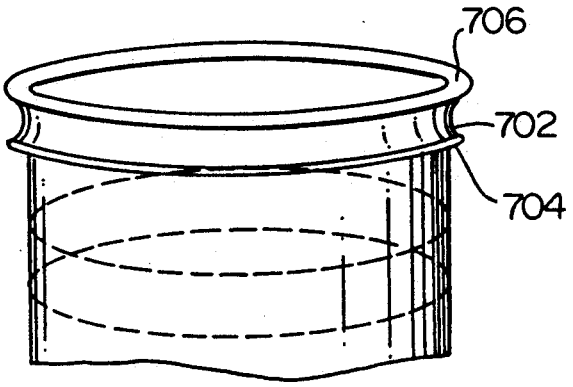
FIG. 7 is a side view of the circular track mounted on the bag.

FIG. 5 shows a top view of the two level surface 306. This view shows the center point 504 through which the connection rod 202 (not shown) passes. The first level 310 is equipped with a plurality of openings 502, each for holding one individual golf club at the level provided by first level 310, and the second level 312 is equipped with a plurality of openings 514, each for holding an individual golf club, preferably woods, at the higher level provided by the second level 312, so as to be further separated from the heads of the irons that are held in the plurality of openings 502 on the first level 310.

Referring now to FIGS. 6 to 8 and 12 wheels 602, preferably made of nylon are rotatably mounted on axles 604 which axles in turn are mounted adjacent the open end 110 of cap 108.

Figure 12:
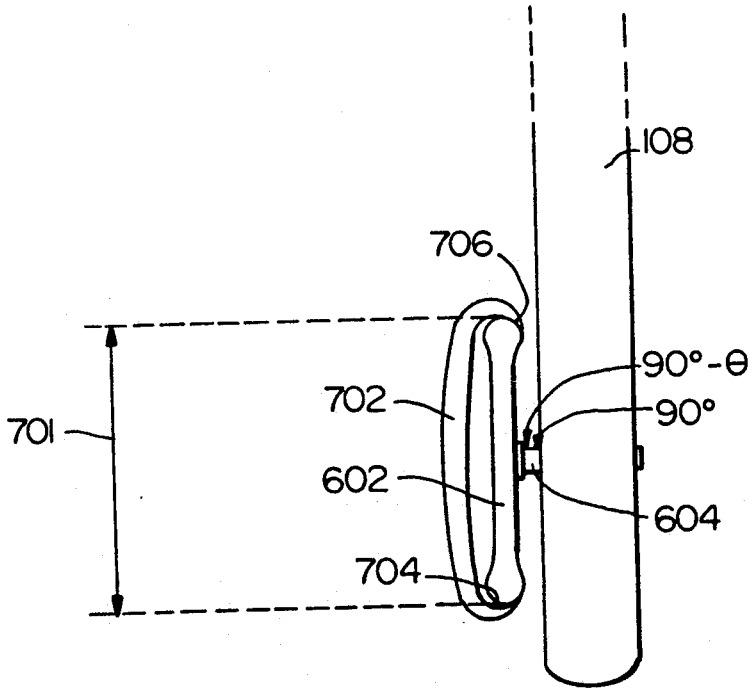
FIG. 12 shows a cross-sectional view of a wheel 602 attached to the rotary cap 108 via an axle 604 and positioned within the track 702.

Referring in particular to FIG. 12, the width 701 of the track 702 is slightly larger than the diameter of the wheel 602 so that the wheel 602 can rest on a bottom lip 704 which curves around the bottom edge of the wheel 602 and be held flush to the track 702 by an upper lip 706 which curves around the upper edge of the wheel 602 without interfering with the rotational capability of the wheel along the point of contact with the lower lip 704 of the track 702. Preferrably wheel 602 is oriented in its hub relative to the track two or three degrees off of a plane perpendicular to the wheel's axle 604 so that the bottom edge of the wheel 602 is positioned closer to the interior of the track 702 than the upper edge of the wheel 602, which is thereby resting more towards the upper lip 706 away from the interior of the track 702. This preferred orientation would maintain a 90° angle between the axle 604 and the inside surface of the rotary cap 108, as well as a 90°-d angle between the axle 604 and the plane of the wheel 602, where d is 2 or 3 degrees as described above. Wheels 602 and/or track 702 should be made of a resiliently deformable material so as to permit wheels 602 to be press loaded into the track 702, and once there captured in place. Alternatively, track 702 should be dimensioned so that the wheels 602 may be lifted over the track lower lip and loaded in place. In such case upper lip 706 should be made long enough to capture the wheels 602.

Figure 8:
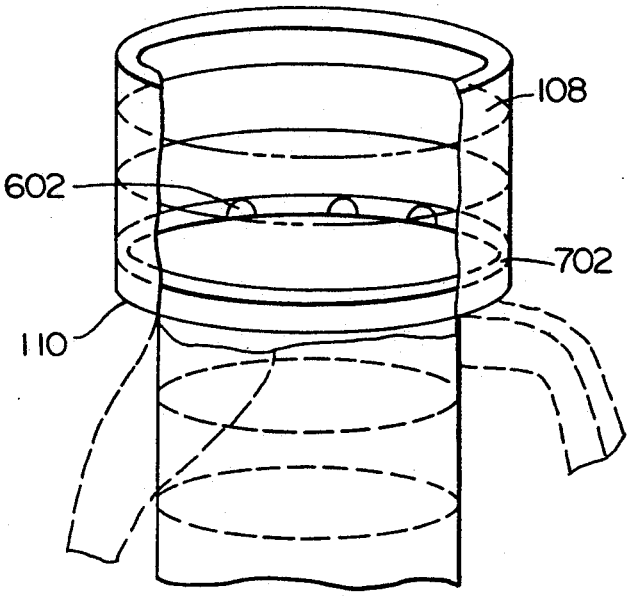
FIG. 8 is a cut away view of the inside of the rotary cap showing a plurality of wheels positioned within a circular track.

FIG. 8 shows a cut-away view a plurality of the wheels 602 positioned within the track 702 and interspersed evenly around the open end 110 of the rotary cap 108 so as t provide a plane of wheels attached by their axles and extending from the inside wall of the rotary cap 108 adajacent the open end 110, whereby the rotary cap 108 can rotate along the plane of the wheels which in turn rotate freely within the circular track 702. In this way, the clubs remain stationary relative to the golf bag body 102 while the rotary cap 108 can be rotated to select a preferred club. The preferred number of wheels for maximum support is twelve or fourteen and the rail upper lip 706 encompassing the wheels augments the connecting rod 202 function of maintaining the rotary cap 108 on the golf bag body 102.

Figure 9:
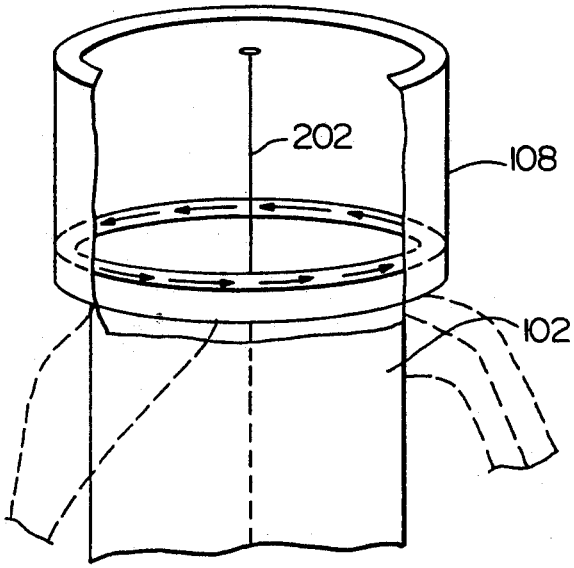
FIG. 9 is a cut away view of the rotary cap attached to the bag with connecting rod shown attached to the center of the rotating cap and directional arrows showing the direction of rotation of the rotary cap in the track.

FIG. 9 illustrates the manner of rotation of the rotary cap 108 relative to the golf bag body 102 along the axis of rotation defined by the connection rod 202.

Figure 10:
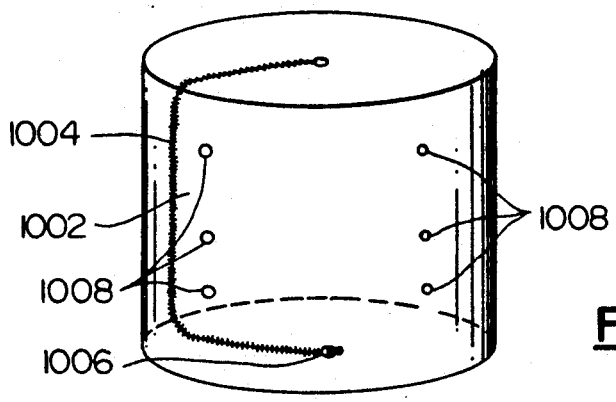
FIG. 10 is a side view of the rotary cap with a cap opening flap secured in a closed position with a zippered fastener.

FIG. 10 shows a covering flap 1002 formed, for example, of a flexible reinforced plastic fabric or the like secured in a closed position by zipper 1004 which begins at locking point 1006 and opens by moving the zipper laterally, then upward, then laterally again so as to unzip the covering flap 1002. Snaps 1008 are provided to secure an unzipped flap in an opened position.

Figure 11:
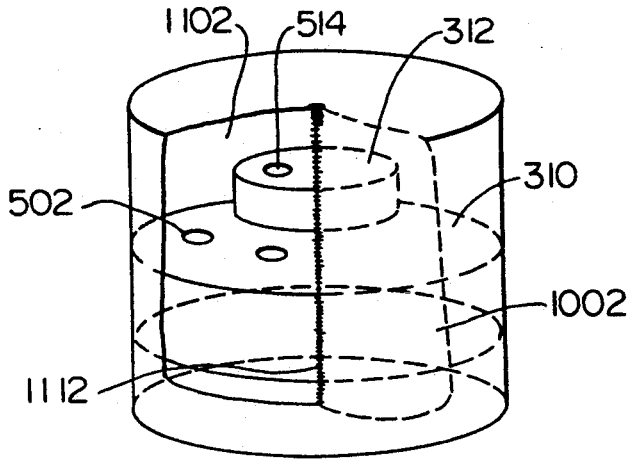
FIG. 11 is a view of the rotary cap similar to FIG. 10 with the cap opening flap secured in an opened position and showing the two level-inner bag top surface complete with golf club holes.

FIG. 11 shows the covering flap 1002 secured in an opened position so as to expose a cap opening 1102 which enables access to a minimum of club heads in either the openings 502 in the first level 310 or the opening 514 in the second level 312. The preferred number of openings accessible at any one time by the opening 1102 is two openings on the first level 310 and one opening on the second level 312. Alternatively, flaps 1002 may be fully removable, e.g. by continuing the zipper along edge 1112 as shown in FIG. 11.

A feature and advantage of the enclosed golf bag is that all golf clubs inside the closed golf bag are completely enclosed. Therefore neither head covers for the clubs nor separate travel bags required by most airlines are necessary. Further, since the golf bag is totally enclosed, all individual golf clubs remain dry and the need for a golf bag rain hood is eliminated.

Another feature and advantage of the present invention is the reduction in the potential loss of golf clubs. The rotary cap provides a sizable top-to-side opening which exposes and permits accessibility of a plurality of club heads, preferably three, thereby enhancing club identification and simplifying the extraction of the desired club or clubs with a top-to-side removal motion relative to the body of the present invention. In accordance with a preferred embodiment of the present invention, the maximum of three clubs are exposed at anytime when the flap covering for the cap opening is not secured in a closed position. Further, the top-to-side opening within the rotary cap permits simple golf club extraction.

A further feature and advantage of the present invention is increased protection for all of the club heads within the enclosed golf bag due to the two-level design of the inner top surface. With this two-level design, wood clubs are stored at a different level from the iron clubs. This feature greatly reduces scarring and chipping of club faces.

Figure 13:
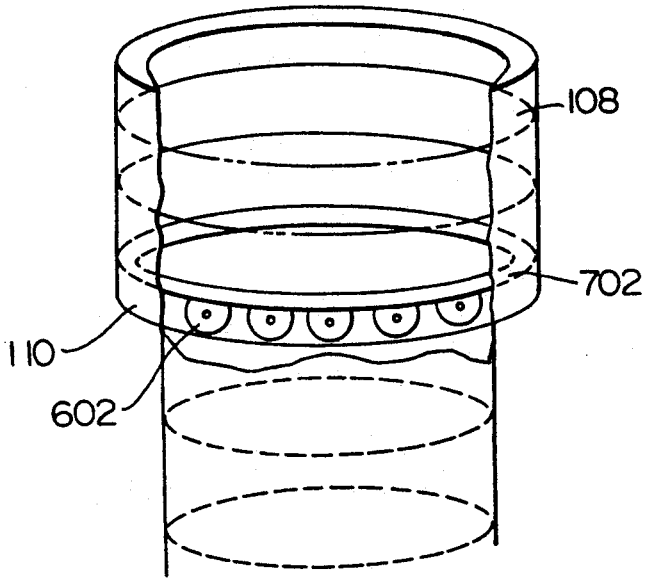
FIG. 13 is a cut-away view of an alternate preferred embodiment wherein the wheels are mounted on the bag body and the track is carried on the cap.

Yet another feature and advantage of the present invention is the elimination of the need for outside locking devices. The present invention provides for a zipper or fastener attached to the flap covering which has locking capabilities. Also, in an alternative embodiment of the present invention shown in FIG. 13, the plurality of wheels may be mounted on the bag body and the track may be mounted on the cap.

A still further feature and advantage of the present invention is the elimination of the clips, ball bearings, rollers, cups, guides or pins typically required in prior art bags in which the clubs are rotated within the bag relative to the external surface of the bag. Thus, the present invention is more economic to produce.

Various changes may be made in the above described invention without departing from the spirit and scope of the invention. For example, the cap may be formed of a transparent material such as a transparent plastic to permit one to know the contents of the bag. Also, the wheels may be mounted on the bag body and the rail on the cap. Still other changes will be apparent to one skilled in the art.

I claim:

1. An enclosed golf bag comprising:

a. a golf bag body having a first open end and a second closed end;

b. a track mounted circumferentially on an outside surface of said bag body adjacent said first open end; and c. a cap having an open end and a closed end and including a plurality of wheels rotatably coupled by axle means to an inside surface of said open end, said track including means for removably receiving and capturing said wheels to permit said cap to be rotatably mounted on said bag body.

2. An enclosed golf bag according to claim 1, and further comprising a cover attached to said cap and defining a portion of said cap closed end, said cover having means permitting it to be movable between an open position and a closed position to provide a closable opening.

3. An enclosed golf bag according to claim 2, wherein said cover includes means for detachment from said cap.

4. An enclosed golf bag according to claim 2, and further comprising means for fixing said cover in said closed position.

5. An enclosed golf bag according to claim 2, and further comprising means for fixing said cover in said open position.

6. An enclosed golf bag according to claim 4 wherein said fixing means comprises a zipper.

7. An enclosed golf bag according to claim 5 wherein said fixing means is at least one snap.

8. An enclosed golf bag according to claim 1 wherein said cap is transparent to permit viewing of the contents of the bag.

9. An enclosed golf bag according to claim 1, and further comprising a bag insert having a two-level surface for supporting selected club heads at one of two levels.

10. An enclosed golf bag according to claim 1, and further comprising a connecting rod running between said golf bag body second end and said rotary cap closed end.

11. An enclosed golf bag comprising:

a. a golf bag body having a first open end and a second closed end;

b. a plurality of wheels rotatably coupled by axle means to an outside surface of said bag body adjacent said first open end; and c. a cap having an open end and a closed end and including a track mounted circumferentially on an inside surface of said open end, said track including means for removably receiving and capturing said wheels to permit said cap to be rotatably mounted on said bag body.

* * * * *